US006339863B1

(12) United States Patent
Kuo

(10) Patent No.: US 6,339,863 B1
(45) Date of Patent: Jan. 22, 2002

(54) MULTI-STEP POSITIONING DEVICE OF TRUNK PULL ROD

(75) Inventor: Chung-Hsien Kuo, Taipei Hsien (TW)

(73) Assignee: Chaw Khong Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 09/598,022

(22) Filed: Jun. 21, 2000

(51) Int. Cl.[7] ..... B25G 1/04; A45C 3/00

(52) U.S. Cl. ..... 16/113.1; 280/655; 280/47.371; 190/115

(58) Field of Search ..... 16/113.1, 429, 16/405; 280/655, 655.1, 47.315, 47.371; 190/115, 39; 403/92–94, 109.2, 109.3

(56) References Cited

U.S. PATENT DOCUMENTS 5,584,097 A * 12/1996 Lu ..... 16/113.1
5,704,725 A * 1/1998 Horing ..... 16/113.1
5,875,520 A * 3/1999 Chang ..... 16/113.1
5,956,807 A * 9/1999 Kuo ..... 16/113.1
6,141,828 A * 11/2000 Kuo ..... 16/113.1
6,148,477 A * 11/2000 Cheng ..... 16/113.1
6,223,391 B1 * 5/2001 Kuo ..... 16/113.1

* cited by examiner

*Primary Examiner*—Chuck Y. Mah
(74) *Attorney, Agent, or Firm*—Rosenberg, Klein & Lee

(57) ABSTRACT

A multi-step positioning device of a trunk pull rod has a pair of pull rods at two sides thereof. Each pull rod has an inner upper rod and an outer lower rod therein. The rod body has two sides of round arc shapes. After engaging, the round arc portions of the two rods are formed with gaps. Porous pieces are placed in the gaps. The porous piece passes through the outer lower rod. The upper end of the outer lower rod is connected to an upper rod sleeve. Protruding buckles at two sides of the upper rod sleeve buckles with the buckling holes with respect to the outer lower rod. The lower end of the inner upper rod is connected to a lower rod sleeve. The slender end of the lower rod sleeve passes through the inner upper rod. The enlarged end portion has a part identical to the inner upper rod for being engaged with the porous piece. The enlarged end portion has a part having an inner diameter identical to that of the outer lower rod for being passing through the outer lower rod. The middle rod sleeve has a sliding groove at the lateral surface thereof for being inserted by a sliding block and a spring. The sliding block is connected to a driving piece. The driving piece passes through the inner upper rod to be connected to the pull piece of the handle.

11 Claims, 7 Drawing Sheets

MULTI-STEP POSITIONING DEVICE OF TRUNK PULL ROD

FIELD OF THE INVENTION

The present invention relates to a multi-step positioning device of a trunk pull rod, which is especially suitable to a pull rod fixing means being adjusted steplessly.

BACKGROUND OF THE INVENTION

Traveling for business or other purposes is prevailed currently, and thus trunks becomes a required tool in traveling. Telescopic pull rods are important components in the design of a trunk, which can provide great convenience to the travelers. Since the height of everyone is different, while it is preferred that the trunk is pulled by an angle of 45 degrees. In order to meet various demands, two sectional or multiple sectional pull rods are preferred and are widely used. Rods with two sections and one operation step is generally used in the design of trunks. Namely, after the upper section of the pull rod is pulled out, only the lower end of the upper sectional rod and the upper end of the lower sectional rod is positioned. The use of each sections of the rods is not well designed. There are some difference according to the height of the trunk. Therefore, a three sectional rod or a four sectional rod is designed. However, the operation of these multi-sectional rod is not preferred since it can not be fine adjusted. Therefore, a multi-sectional or stepless structure is designed. Furthermore, the positioning of the two sectional rod is not confined in a single position. Many positions serves to position the rod. Even every position is usable. The positions for positioning is conventionally installed with continuous holes. However, this will deteriorate the outlook, and weak the structure. In another design, the positioning structure is installed in the rod. FIG. 7 shows a prior art structure. A positioning piece 1 is installed in the outer rod. The positioning piece 1 is installed with a bank of positioning holes 11 for achieving the object of multiple step adjustment for satisfying the requirement of the user. As shown in the figure, the positioning piece is necessary to be installed in the rod, therefore, a buckling structure is installed in the outer rod 2, in which a pair of inward protruding strips 11 are used. Although the shape of the outer rod 2 has a long elliptic shape, the inner rod has a square shape, and therefore, the visual feeling is effected. Another, the outer rod is a rectangular rod, while the inner rod is a square rod, but this is not good in visual feeling, since square rod looks very bulky. Thus, it is not met the requirement of compactness and it has many defects. Besides, a pull rod adjusting means of gears and racks is designed, wherein the gear must be adjusted precisely for positioning. It is inconvenient to the user. Furthermore, the whole structure is heavy and is almost not used commercially. An adjusting rod of teeth block and rack is designed, further. Although it has the advantages of steplessness, the application is limited. Too many adjustments cause the user not to select it properly. However, from the experiences of the applicant, there are a great extent in the design of the pull rod to satisfy the requirement of consumers.

SUMMARY OF THE INVENTION

Accordingly, the primary object of the present invention is to provide a multi-step positioning device of a trunk pull rod for using the space of the pull rod more efficiency so that the original two rod types are converted to a multiple rod type. Furthermore, elliptic rods are used instead of the conventional square rods. By the space between inner and outer rods to clamp the porous piece, the shape of the porous piece is formed as cambered rod for using space sufficient. Besides, the spring buckling buckling device is used to be buckled with the porous piece. Therefore, most of the requirement in use is satisfied. Moreover, the porous piece of the present invention is matched with a handle to be adjusted in positions so that the whole structure is more convenient.

Another object of the present invention is to provide a multi-step positioning device of a trunk pull rod, which can be used in the adjustment of a third sectional rod. Each section is used in an optimum condition. Each rod is retained in a specific shape for saving space.

In the present invention, A multi-step positioning device of a trunk pull rod has a pair of pull rods at two sides thereof. Each pull rod has an inner upper rod and an outer lower rod therein. The rod body has two sides of round arc shapes. After engaging the round arc portions of the two rods are formed with gaps. Porous pieces are placed in the gaps. The porous piece passes through the outer lower rod. The upper end of the outer lower rod is connected to an upper rod sleeve. Protruding buckles at two sides of the upper rod sleeve buckles with the buckling holes with respect to the outer lower rod. The lower end of the inner upper rod is connected to a lower rod sleeve. The slender end of the lower rod sleeve passes through the inner upper rod. The enlarged end portion has a part identical to the inner upper rod for being engaged with the porous piece. The enlarged end portion has a part having an inner diameter identical to that of the outer lower rod for being passing through the outer lower rod. The middle rod sleeve has a sliding groove at the lateral surface thereof for being inserted by a sliding block and a spring. The sliding block is connected to a driving piece. The driving piece passes through the inner upper rod to be connected to the pull piece of the handle.

The various objects and advantages of the present invention will be more readily understood from the following detailed description when reading in conjunction with the appended drawing.

DETAILED DESCRIPTION OF THE PREFERRED EMBODIMENTS

Figure 1:
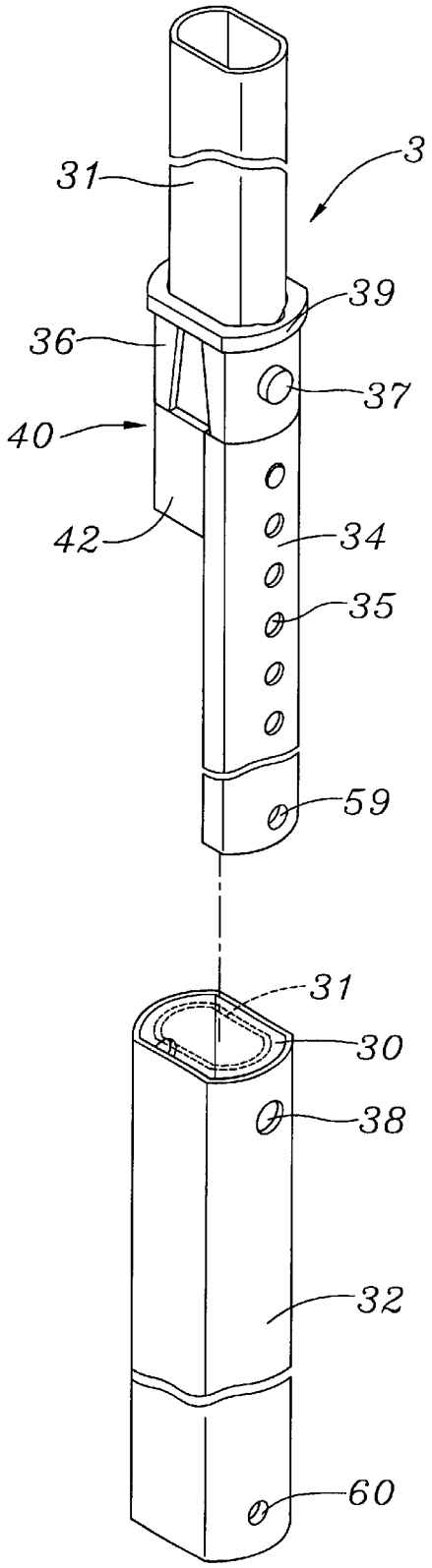
FIG. 1 is a perspective view of the present invention.
Figure 2:
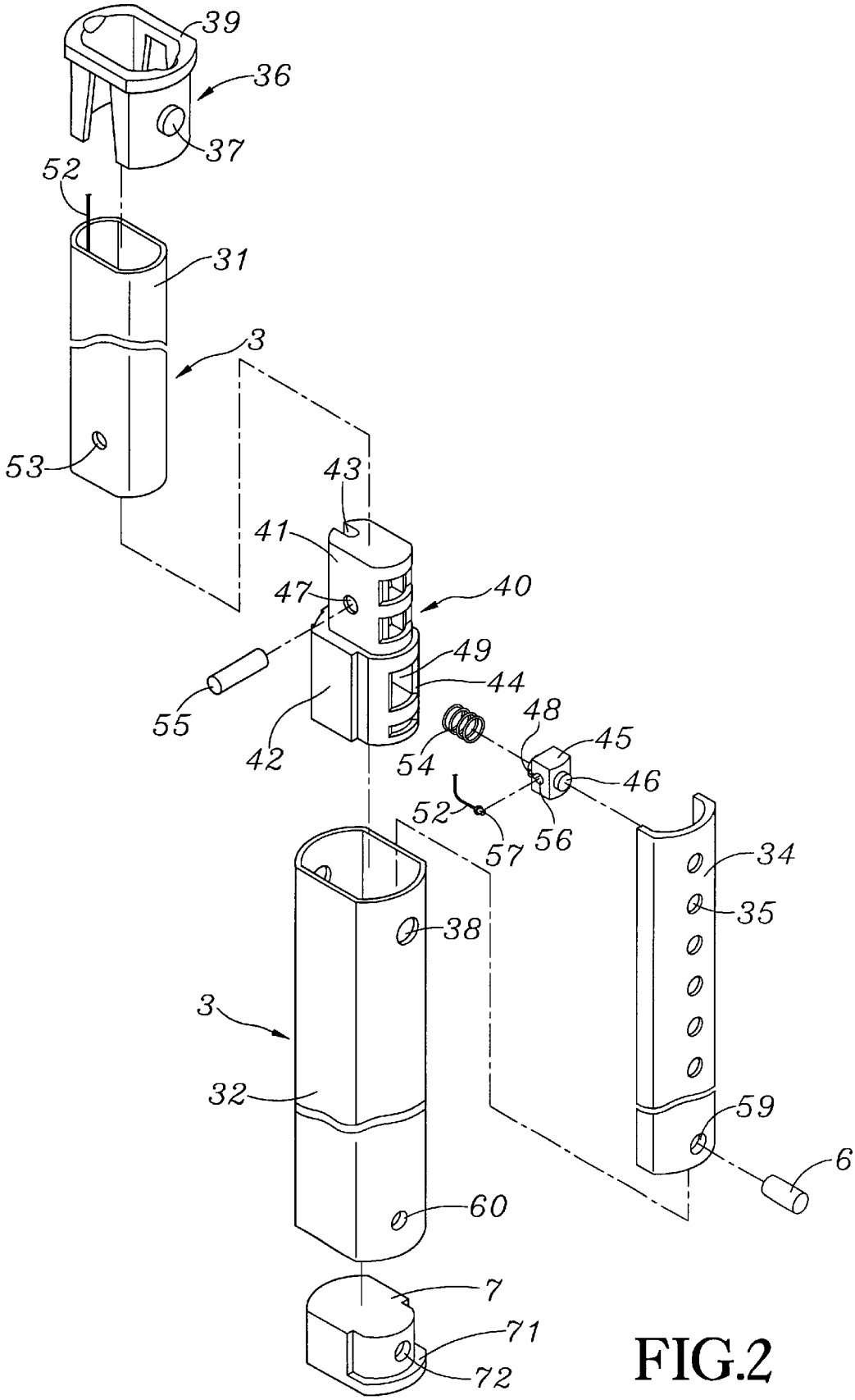
FIG. 2 is an exploded perspective view of the present invention.
Figure 3:
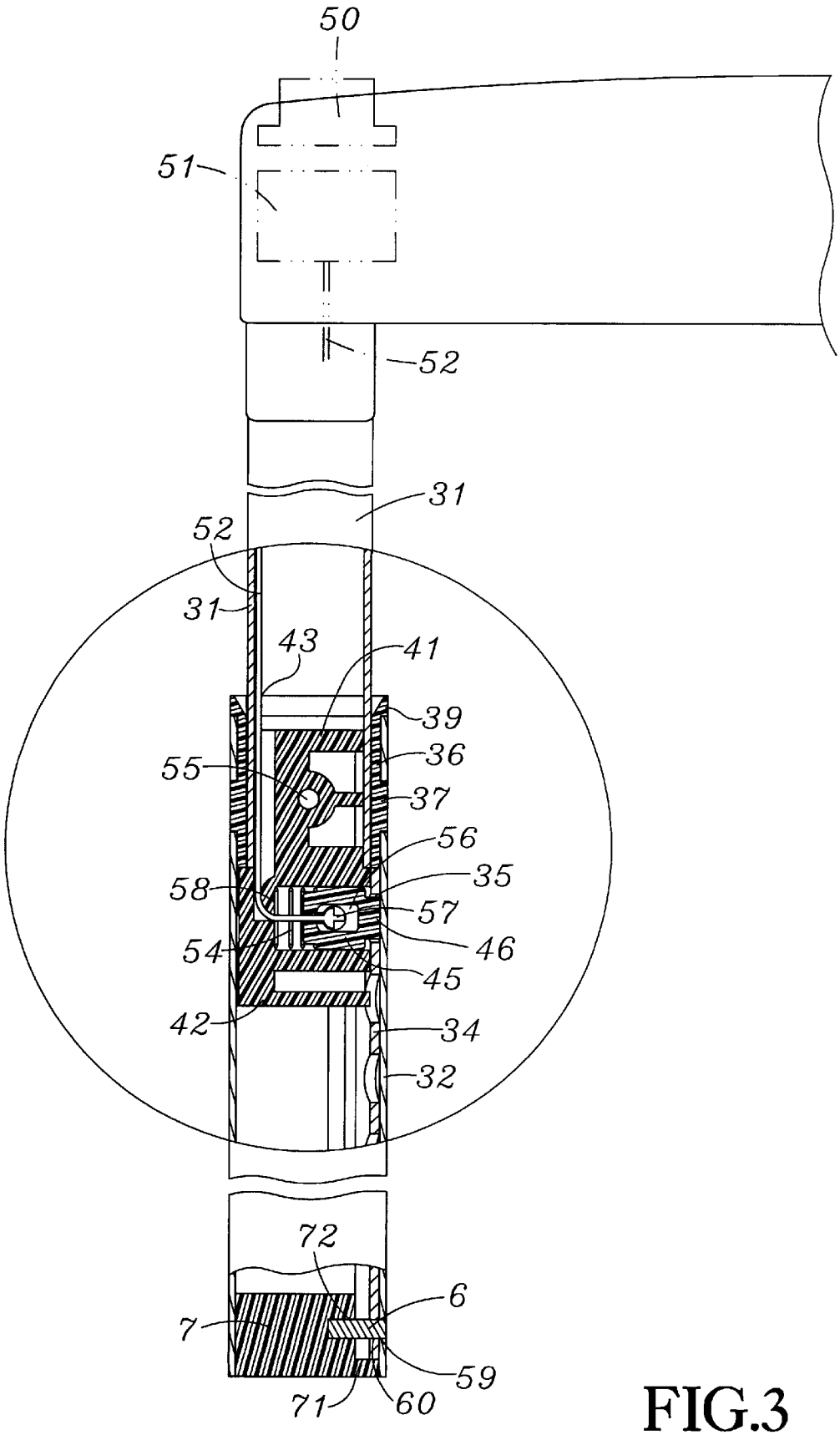
FIG. 3 is a partial cross sectional view showing that the present invention is not moved.
Figure 4:
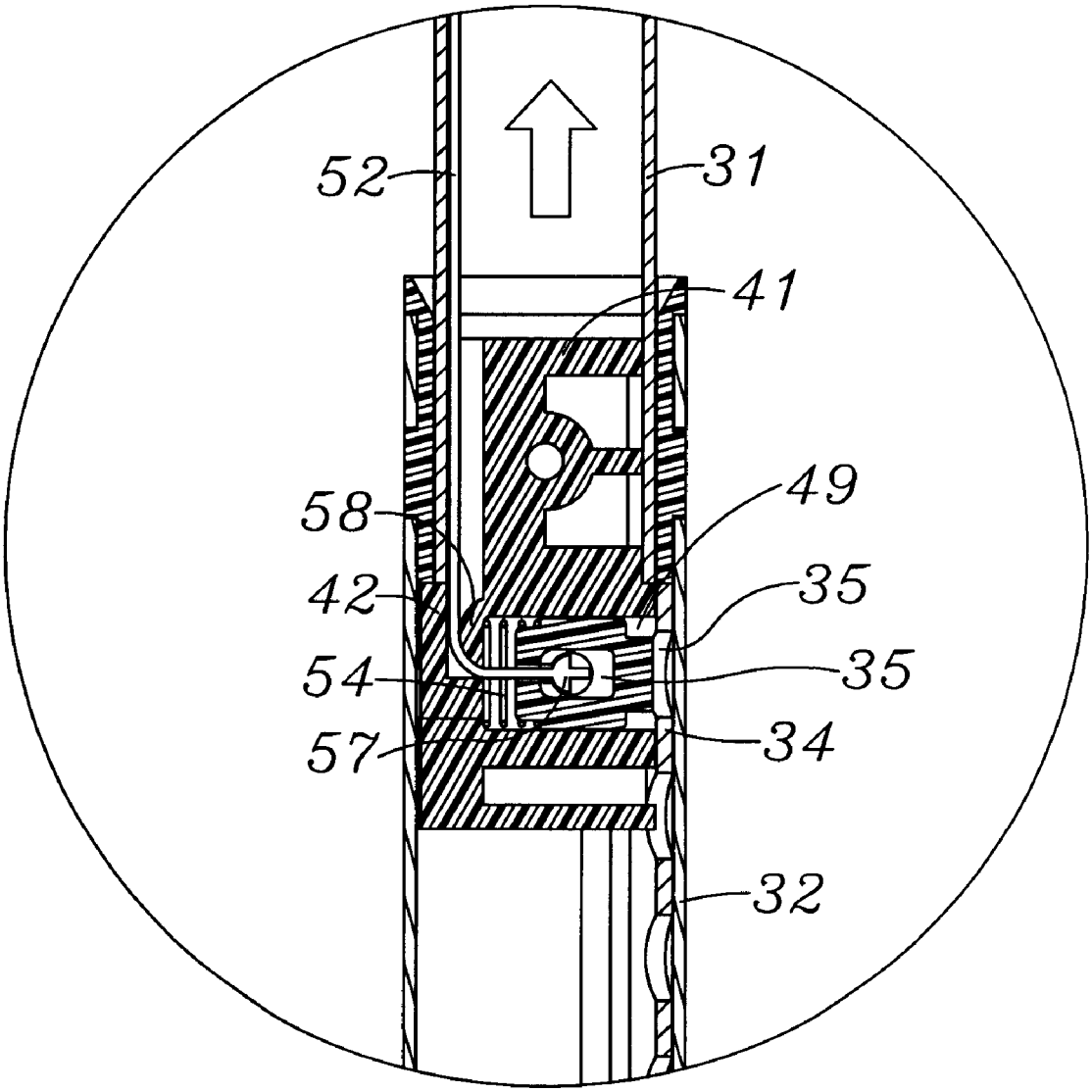
FIG. 4 is a partial cross sectional view of FIG. 3 wherein the sliding piece is pressed.
Figure 5:
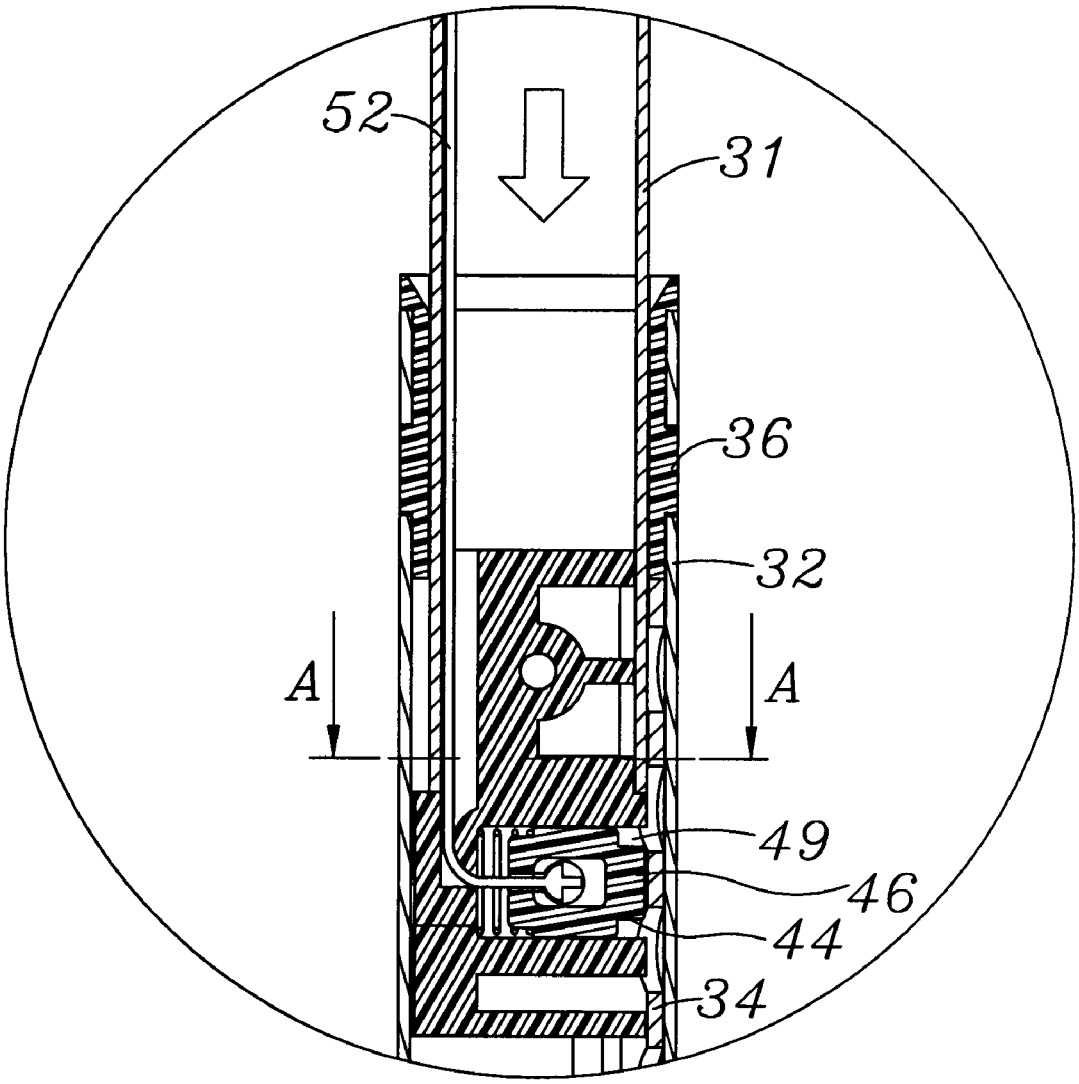
FIG. 5 is a partial cross sectional view showing the pull rod in FIG. 3 being moved.
Figure 6:
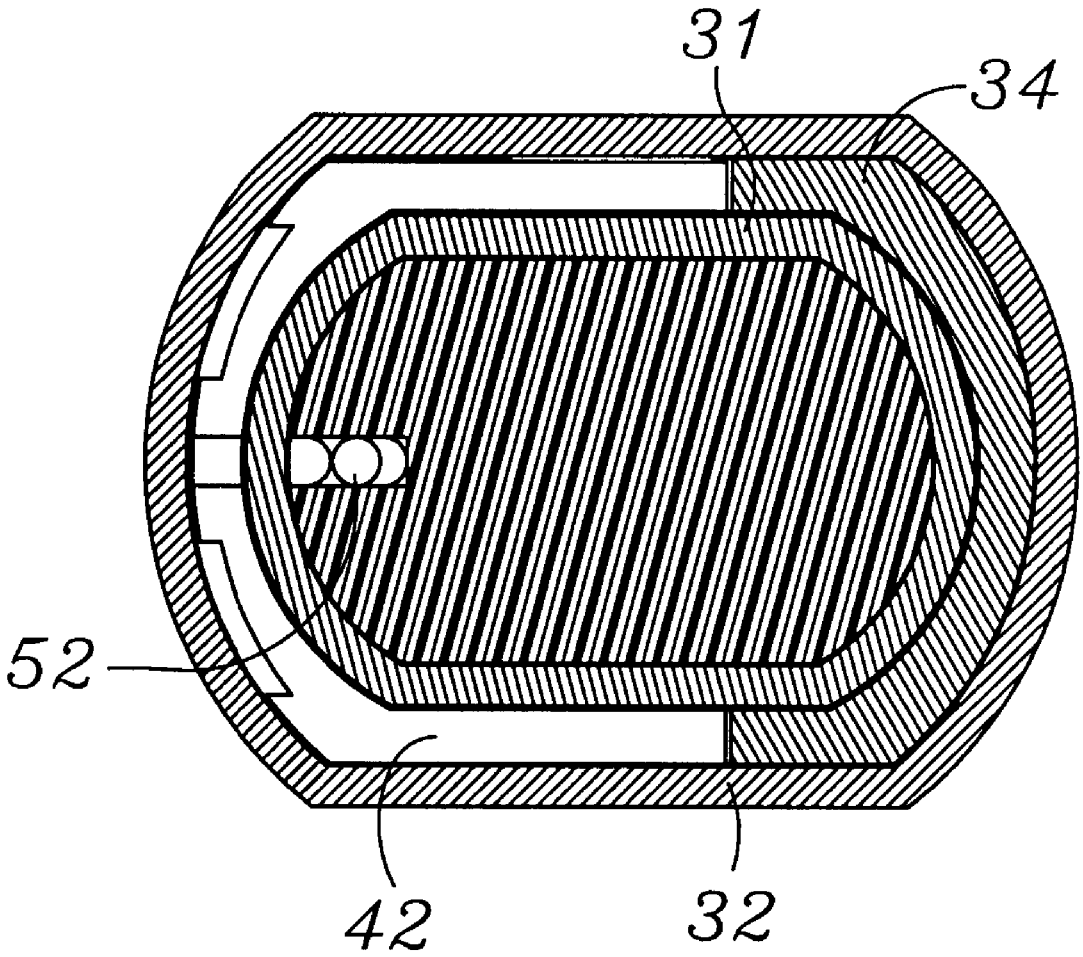
FIG. 6 is a cross sectional view along line A—A of FIG. 5.
Figure 7:
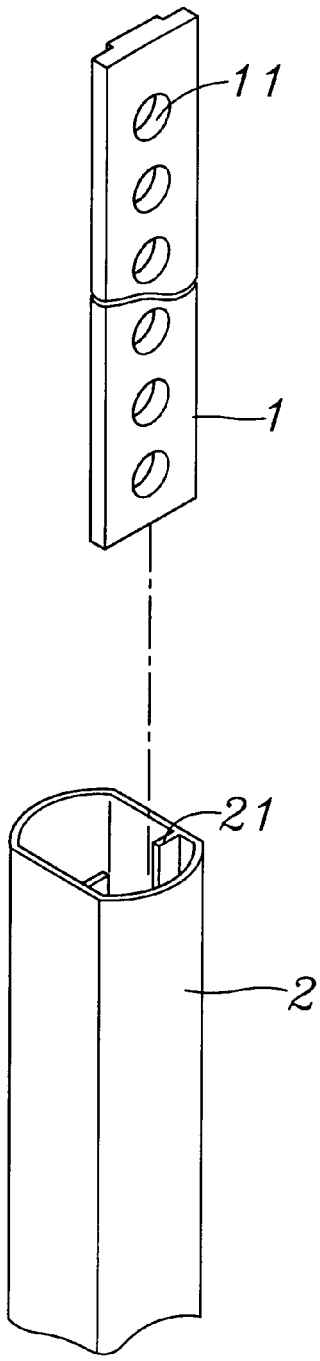
FIG.7 PRIOR ART
FIG. 7 is a perspective view of a prior art design.

With reference to FIGS. 1 to 6 a multi-step positioning device of a trunk pull rod of the present invention is illustrated therein. The multi-step positioning device of a trunk pull rod has a pair of pull rods 3 installed towards the rear of the trunk. A handle 5 is connected between the two pull rods 3 includes an inner upper rod 31 and then outer lower rod 32. The rod body of the pull rod 3 has two sides with a long elliptic shape. The round arc portions of the two rods 31 and 32 are engaged with one another, and thus a gap 30 is formed therebetween. A porous piece 34 is placed in the gap 30 at one or two sides. The porous piece 34 is fixed in the outer lower rod 32 and has a long cambered strip shape. A plurality of holes arranged in spaced manner are formed on the porous piece 34. The upper end of the porous piece 34 bears against the lower end of the upper sleeve 36, while the lower end of the porous piece 34 is formed with a lower inner fixing hole 59. An outer fixing hole 60 is formed at the lower end of the outer lower rod 32. A short pin 6 is inserted through the lower outer fixing hole 60 and the lower inner fixing hole 59 so that the object of fixing the porous piece 34 is achieved. A plug 7 is inserted in the outer lower rod 32. The lower end of the plug 7 near the porous piece 34 is formed with a round groove 71 for engaging the porous piece 34, and the short pin 6 inserts into the transversal hole 72 of the plug 7. Therefore, the porous piece 34 is fixed. The cross section of the porous piece 34 can have a round arc shape, a polygonal shape, or another shape such as a round body with two parallel sides.

The upper end of the outer lower rod 32 is connected to the upper rod sleeve 36. Each of the two sides of the upper rod sleeve 36 has a respective protruded buckle 37 for buckling the outer lower rod 32 with respect to a buckling hole 38. The top 39 of the upper rod sleeve 39 is buckled in the top end of the outer lower rod 32. The outer lower rod 32 has an upper end connected to an upper rod sleeve 36. Two sides of the upper rod sleeves 36 each have a protruded buckle 37 for being buckled to the buckling hole 38 with respect to the outer lower rod 32. The upper rod sleeve 36 has a top edge 39 the lower edge of which is buckled to the top surface of a middle tube 32.

The lower end of the inner upper rod 31 is connected to the middle rod sleeve 40. The slender end portion of the middle rod sleeve 40 passes through the inner upper rod 31, and part of the enlarged end portion 42 thereof has an outer diameter identical to that of the inner upper rod 31, part of that portion has an inner diameter identical to that of the outer lower rod 32 and passes through the outer lower rod 32. The inner top surface of the middle rod sleeve 40 is formed with a through hole 43 for being inserted by a driving piece 52. One end of the driving piece 52 is connected to a sliding piece 45. The driving piece 53 passes through the inner upper rod 31 to be connected to a pull piece 51 on the handle 5. The pull piece 51 is driven by a pressable piece 50, or the pull piece 51 can be pulled directly. At least one end hole 44 of a sliding groove 49 is installed on enlarged portion 42 of the middle rod sleeve 40 facing the porous piece 34. Each end hole 44 is passed by the buckling end 46 of the sliding block 45. The buckling end 46 slides out of the end hole 44 of the middle rod sleeve 40 to be embedded in the hole 35 of the porous piece 34, and then is buckled by the sliding block 45 so to position the two rods 31 and 32 to be motionless. If the buckling end 46 slides back to the end hole 44 of the middle rod sleeve 40, then the position of the rods 31 and 32 is released and thus, each of rods 31 and 32 may move freely. A groove seat 56 in formed at one lateral surface of the sliding block 45 for fixing a fixing head 57 which is one end of the pull piece 51. After the pull piece 51 passes through the sliding block 45, it directly passes through one arc portion 58 for being formed as a rectangular bending to extend upwards to pass through the through hole 43.

A pin hole 53 is installed near the lower end of the inner upper rod 31 . A fixing hole 47 is installed in the middle rod sleeve 40. A pin 55 passes through the pin hole 53 to fix with the fixing hole 47 of the middle rod sleeve 40. The middle rod sleeve 40 does not separate from the inner upper rod 31. The movement of the middle rod sleeve 40 is completely driven by the inner upper rod 31. Since the sliding block 45 of the present invention only provides an application of pulling upwards, a spring is arranged at one side of the sliding block 45. In the pulling upward application shown in FIG. 4, a compressible spring 54 is installed between the sliding block 45 and the inner lateral surface of the middle rod sleeve 40.

In summary in the present invention, a porous piece is installed between the elliptic rods to match with the fixing of the middle rod sleeve and the upper rod sleeve. If the porous piece is not very long, it can be combined with the middle rod sleeve. Then, the buckling end moves in the through hole of the middle rod sleeve. The driving piece connected to the sliding block serves to control the moving out or restoring of the buckling end. Because the handle has many different structures, the details will not be described herein. It is appreciated that the present invention uses a minimum volume and rods to complete the assembly of the present invention. The assembly work is easy and simple. It is suitable in pulling up and pushing down process.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A multi-sectional pull rod assembly for adjustably supporting a pull handle comprising:

(a) a first rod;

(b) a second rod disposed telescopically in relation to said first rod, said second rod having at least one buckling hole formed therein;

(c) a first rod sleeve disposed between said first and second rods, said first rod sleeve being coupled in locked manner to said second rod and slidably receiving said first rod therethrough;

(d) a longitudinally extended porous piece disposed within said second rod, said porous piece having formed therein a plurality of longitudinally spaced holes;

(e) a second rod sleeve coupled in locked manner to said first rod, said second rod sleeve having longitudinally offset first and second end portions, said second end portion maintaining slidable engagement with said porous piece and said second rod, said second end portion having a sliding groove compartment formed therein, said first end portion fixedly engaging a terminal end portion of said first rod;

(f) a laterally displaceable sliding piece received in said sliding groove compartment of said second rod sleeve for displacement between releasing and locking positions, said sliding piece being resiliently biased to said locking position, said sliding piece having protruding therefrom a buckling end for engaging in said locking position one of said porous plate holes; and, (g) an elongate driving piece coupled to said sliding piece and extending through said first and second rods therefrom.

2. The pull rod assembly as recited in claim 1 wherein said first rod sleeve has formed thereon at least one laterally protruded buckle, said protruded buckle engaging said at least one buckling hole formed in said second rod.

3. The pull rod assembly as recited in claim 1 wherein one end of said porous piece bears against said first rod sleeve, said porous piece being secured together with said second rod by a fastening pin passed therethrough.

4. The pull rod assembly as recited in claim 3 further comprising a plug coupled in locked manner to a terminal end of said second rod, said porous piece being captured longitudinally between said first rod sleeve and said plug.

5. The pull rod assembly as recited in claim 4 wherein said plug, said porous piece, and said second rod are secured together by said fastening pin passed therethrough.

6. The pull rod assembly as recited in claim 1 wherein said porous piece defines substantially an arcuate sectional contour.

7. The pull rod assembly as recited in claim 1 wherein said porous piece defines substantially a polygonal sectional contour.

8. The pull rod assembly as recited in claim 1 wherein said driving piece is flexible.

9. The pull rod assembly as recited in claim 8 wherein said second rod sleeve has formed thereon an arc portion, said driving piece being pivoted about said arc portion.

10. The pull rod assembly as recited in claim 1 wherein said first rod is telescopically disposed relative to said second rod to extend longitudinally upward therefrom.

11. The pull rod assembly as recited in claim 10 wherein said second end portion of said second rod sleeve is greater than said first end portion thereof in radial extent.

* * * * *